United States Patent [19]

Lelu et al.

[11] Patent Number: 4,536,235

[45] Date of Patent: Aug. 20, 1985

[54] COMBUSTION INHIBITORS ON A BASE OF OXYGENATED POLYURETHANE ELASTOMER WHICH CONTAINS FIBERS FOR THE DOUBLE BASE PROPELLANT

[75] Inventors: André Lelu; Bruno Gonthier, both of Saint-Medard en Jalles; Jean Grignon, Pessac; Jean-Michel Tauzia, Blanquefort, all of France

[73] Assignee: Societe Nationale Des Poudres et Explosifs, Paris, France

[21] Appl. No.: 563,355

[22] Filed: Dec. 20, 1983

[30] Foreign Application Priority Data

Dec. 28, 1982 [FR] France ..... 82 21880

[51] Int. Cl.[3] ..... C06B 45/10

[52] U.S. Cl. ..... 149/19.4; 102/290; 523/180; 149/98

[58] Field of Search ..... 102/290, 289, 291, 292, 102/293; 149/19.4, 98; 523/180; 252/182

[56] References Cited

U.S. PATENT DOCUMENTS

| | | | |
|---|---|---|---|
| 3,924,405 | 12/1975 | Cohen et al. | 149/20 X |
| 4,187,215 | 2/1980 | Wrightson | 102/290 X |
| 4,232,608 | 11/1980 | Wrightson | 102/290 X |
| 4,284,442 | 8/1981 | Voigt, Jr. | 149/19.4 |

*Primary Examiner*—Peter A. Nelson

*Attorney, Agent, or Firm*—Bucknam and Archer

[57] ABSTRACT

A combustion inhibitor for a double base propellant is described which comprises a polyurethane elastomer having in chemically combined form a compound which is an aliphatic polyester polyol or an aliphatic polyether polyol, or a mixture thereof, which compound contains 2–6 hydroxyl groups per molecule, and an aliphatic polyisocyanate. The inhibitor also contains 0.1–10 parts by weight of mineral fibers or thermostable organic fibers of length between 0.1 mm and 15 mm per 100 parts inhibitor. The inhibitor may contain an organic gasifiable charge and an aliphatic plasticizer.

9 Claims, No Drawings

COMBUSTION INHIBITORS ON A BASE OF OXYGENATED POLYURETHANE ELASTOMER WHICH CONTAINS FIBERS FOR THE DOUBLE BASE PROPELLANT

The present invention relates to novel combustion inhibitors for double base propellants which comprise a polyurethane elastomer having in a chemically combined form an aliphatic component, a polyesterpolyol or polyetherpolyol or a mixture of these two substances containing between 2 and 6 hydroxyl groups per molecule, an aliphatic polyisocyanate component and optionally, a low molecular weight polyol as an extender of the chains, the inhibitor comprising optionally a gasifiable organic charge and/or an aliphatic plasticizer.

The combustion inhibitors are substances which cover the surface of a propellant block apart from the surface of the combustion zone, which protect the surface from every accidental ignition which could occur, for instance under the action of the warm gas originating from the combustion.

One of the principal functions of the combustion inhibitors, therefore, is to regulate the combustion of a propellant block thus permitting to retain a regular combustion zone during the duration of the latter.

In the case of missiles called "tactic" actual and in the future, one of the essential requirements resides in their capacity to be guided by the firing shot, whatever it is. This implies that the combustion of the propellant block which permits the displacement of the engine, do not emit gas which could obscure the zone behind the engine and which could prevent the registration and its guidance by the firing shot. This brings us to the notion of "discretion" comprised between the direction of transparency with respect to the waves of guidance such as infrared or visible waves.

The double base propellants are, by nature, "discrete", in the sense that the combustion gases do not interfere with the guidance of the engine. The inhibitors, on the other hand, are the principal cause of the phenomena of opacity which occur at the time of combustion, in view of the fact that the superficial layers in contact with the propellant block emit fumes which interfere with the guidance of the engine. This phenomenon is even more pronounced due to the fact that nitroglycerine present in the double base propellant has a tendency to migrate in the inhibitor when the latter presents a certain affinity with it, a fact which increases, therefore, the combustion of the latter and the emission of fumes. Further, the migration of nitroglycerine presents the drawback of separating the inhibitor from the propellant block, a fact which causes prejudicial irregularities in the combustion at the time of firing.

A combustion inhibitor, therefore, must satisfy especially the following requirements: (1) resistance to the migration of nitroglycerine; (2) non-emission of obscuring gases at the time of combustion; (3) a good adherence to the propellant block.

A first solution consists of utilizing a substance which ablates during the combustion developing transparent gases. This solution involves the use of substances which are gasifiable under the action of warm gases. This invention relates to this type of materials and is different from another solution which has been proposed, which resides in the utilization of substances having an excellent thermal behavior such as silicones or aromatic polymers which, in contrast with the preceding substances, do not ablate and do not develop gases which could have an obscuring effect. In order to achieve the inhibitors according to the first solution, it is already been known that the polymers which constitute the materials should not contain practically any aromatic groups.

French Pat. No. 2,275,425 illustrates an embodiment according to which the inhibitor substance consists of an aliphatic polyurethane based on a polyol, an aliphatic polyisocyanate and a cooling charge. However, it is necessary, keeping in mind that an aliphatic polyurethane has affinity for nitroglycerine, to interpose between the inhibitor substance and the propellant block a barrier layer based on a triisocyanate. Due to cross-linking in the presence of moisture, the latter forms a layer having a network of extremely close meshes which prevent the molecules of nitroglycerine from going through. For the purpose of remedying this drawback, it has been proposed in French Patent Application No. 2,444,689 to increase the degree of cross-linking of the polyurethane substance utilizing polyols having low molecular weight.

The object of the present invention is to provide a substantial improvement with respect to the inhibitor materials mentioned hereinabove in the migration of the plasticizer, particularly nitroglycerine and the discretion.

The invention is characterized by the fact that the combustion inhibitors contain 0.1–10 parts by weight of mineral fibers or thermostable organic fibers of length between 0.1 mm and 15 mm per 100 parts inhibitor.

The presence of the refractory fibers is novel insofar as it relates to this type of inhibitors for double base propellants and this is non-obvious. In fact, French Pat. No. 2,275,425, mentioned hereinabove discusses the utilization of mineral charges, such as asbestos, mica, quartz, in the form of powders, for the purpose of improving the stability to heat.

French Pat. No. 2,290,825 mentions an inhibitor composition for double base propellants which consists of an elastomer and a pulverulent charge which constitutes at least 50% of the total composition. It is also there stated that preferably the particles of the substance present in the material which inhibits the composition are of at least one micron size. It is clear that this reference is far from suggesting the incorporation of fibers and rather would have discouraged one skilled in the art from incorporating fibers into the composition.

It should also be noted that French Patent No. 2,150,552 which describes a composition based on an aromatic polyurethane elastomer and 5–65% of fibrous material operates according to the concept of a material which does not ablate (see the second solution described hereinabove).

There is a great difference between the two groups of inhibitors. The group described in French Pat. No. 2,150,552 emits a substantial quantity of fumes during the combustion. The addition of a substantial quantity of fibers is necessary due to the fact that the totality of the inhibitor must be preserved during the entire combustion because otherwise the substance ablated under the action of the warm gases would produce some fumes. This is confirmed by the last paragraph of French Patent No. 2,150,552. On the other hand, in the case of the inhibitors according to the present invention, the fibers do not perform the function of preventing the ablation of the inhibitor but, on the contrary, they permit the substance to be gasified on the spot thus ensuring a superior mechanical behavior on the surface of the material in the process of being gasified.

The term "aliphatic polyurethanes" is used herein to designate polyurethanes which do not contain a substantial amount of aromatic groups. This does not exclude clearly more than a small proportion of groups which may be aromatic but this proportion should not exceed 10%. These polyurethanes must be oxygenated and are produced preferably by the addition of aliphatic polyisocyanates and polyol polyesters or polyol polyethers containing between 2 and 6 hydroxyl groups in the molecule or a mixture of these polyol polyesters or polyol polyethers. Preferably, the ratio between the number of carbon atoms and the number of oxygen atoms in these polyols is less than 5.

The polyurethane compositions which lead to polyurethane elastomers must preferably be flowable, although they may also be formed according to the methods used in the rubber industry if the compositions require them.

The polyols preferably have a moleculare weight between 400 and 5000 and advantageously between 500 and 3000.

The polyesters suitable within the scope of the invention comprise those derived from dicarboxylic acids such as adipic, succinic or sebacic and glycols having low molecular weight such as ethylene glycol, propylene glycol, diethylene glycol, 1,4 butanediol and 1,6 hexanediol. They comprise also polymers of lactones. The latters are polymers formed from polyfunctional initiators by successive decyclization from the lactone monomers.

In general, the lactones within the scope of the invention have the formula:

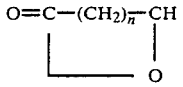

wherein n is lower or equal to 4.

Among the polyesters of this type, one may mention poly-ϵ-caprolactone or poly-γ-butyrolactone. One may also utilize the adducts of these polyesters with polyols having low molecular weight.

The polyethers suitable within the scope of the invention are polyethylene glycol, polypropylene glycol, polypropylene ethylene glycol, polypropylene glycol, polytetramethylene glycol and the adducts of these polyesters with polyols with low moleculare weight such as trimethylolpropane, glycerol, pentaerythritol and sorbitol.

It is equally possible to add to these compositions substances which act as chain extenders such as the glycols having low molecular weight, for instance 1,4-butanediol or diamines. The ratio NCO:OH preferably is equal to 1 or close to 1.

The cross-linking is carried out in the presence of well known catalysts such as, for instance, catalysts having a tin base such as dibutyl tin diacetate. For reasons of mechanical considerations, one prefers to utilize polyol polyethers. However, it is equally advantageous to use these polyol polyethers in a mixture with a polyactone such as ϵ-polycaprolactone.

In addition, it is advantageous to add in a well known manner, an aliphatic plasticizer to the polyurethane composition such as, for example triacetate glycerol or acetyltri-tri-n-butyl citrate. It is possible to add up to 40 parts of plasticizer per 100 parts of polyurethane.

Certain gasifiable organic charges having a melting point equal or higher than the melting point of the polyurethane may also be advantageously added. It is possible to add up to 300 parts of these charges per 100 parts of polyurethane, the only limit being in the flowability of the composition and the essential mechanical properties which must be exhibited by a composition to be used as inhibitor. Therefore, by way of illustration, one may mention: oxamide, ammonium oxalate, ammonium carbonate, polyoxyethylene, polyoxypropylene and polyoxymethylene. These charges must preferably be non-hygroscopic because the presence of water interferes with the cross-linking.

There are preferably used oxygenated organic charges which present a ratio of the number of carbon atoms to the number of oxygen atoms close to 1 in a manner to favor the oxydation reactions with respect to the reactions of polymerization and preferably in a form of fine granules.

The presence of oxygen in fact has a positive effect as it is possible to achieve the absence of slag formation.

Oxamide is advantageously used because of its high melting point in a range of 400° C.

The aliphatic polyisocyanate constituent consists preferably of an aliphatic or cycloaliphatic diisocyanate. With respect to the fibers within the scope of the present invention, one may mention among the suitable fibers, glass fibers, carbon fibers, silicon carbide fibers, asbestos fibers and polyphenylene terephthalamide fibers commercially known under the Dupont de Nemours trademark "Kevlar".

The combustion inhibitor advantageously comprises 0.3–8 parts by weight of fibers of length between 0.1 and 6 mm and preferably 0.5–4 parts by weight per 100 parts of inhibitor.

The invention is carried out as follows:

A double base propellant block is placed concentrically in a cylindrical mold in such a manner that there is a regular interstice between the surface of the block and the internal wall of the mold. In a suitable vat, the constituents of the polyurethane, optionally the cooling charge, the plasticizer and the fibers are mixed by means of a kneader. When the mixture is homogeneous, one proceeds with the step of inhibition more frequently by a process of injection.

The examples hereinbelow illustrate the invention. The tests reported herein have been carried out with the following propellant composition expressed in percentage by weight:

| | |
|---|---|
| Nitrocellulose | 40.2% |
| Nitroglycerine | 36.5% |
| Triacetin | 8.2% |
| Hexogen | 9.1% |
| Combustion Catalysts ballistic, of polymerization | 6.0% |

I—MEASURE OF MIGRATION OF NITROGLYCERINE

The increase in weight of the inhibitor is measured at regular intervals by immersion of a sample of the inhibitor in the nitroglycerine and the increase in weight is followed. The following inhibitor compositions expressed in parts by weight have been tested.

COMPOSITION 1

| | |
|---|---|
| Polyethertriol of MP 430, GP 430 (R) (Marketed by Pechiney Ugine Kuhlman) | 18.8 |
| Triacetin | 9.3 |
| Oxamide | 52.4 |
| 4,4 dicyclohexylmethane diisocyanate | 19.5 |
| Catalyst (tin salt) | 0.1 |
| carbon fibers of 1 mm length | 2.0 |

The rate of absorption is:
1% after 24 hours
2.2% after one week
5% after six weeks

COMPOSITION 2

The same composition as in Example 1 is used but the carbon fibers are replaced by Kevlar (R) fibers of length 0.5 mm (marketed by Dupont de Nemours).
The rate of absorption is:
1.1% after 24 hours
2.5% after one week
5.2% after six weeks

COMPOSITION 3

The same composition as in Example 1 is used but 2.2',3-trimethyl hexane 1,6 diisocyanate is used.
The rate of absorption is:
1% after 24 hours
2.8% after 1 week
7.1% after one month

COMPOSITION 4

| | |
|---|---|
| Polyethertriol of P.M 430, GP 430 (R) (marketed by Pechiney Ugine Kuhlman) | 13.9 |
| Trimethylolpropane | 0.7 |
| Polycaprolactone (marketed by the company Hooker, PM = 1500) | 11.8 |
| Triacetin | 4.8 |
| Oxamide | 50 |
| Dicyclohexylmethane 4,4 diisocyanate | 18.8 |
| Catalyst (tin salt) | 0.1 |
| Kevlar fibers | 0.8 |

The rate of absorption is:
1.4% after 24 hours
3% after one week
8% after six weeks

COMPOSITION 5—COMPARATIVE TEST

Composition 1 has been tested without fibers:
The rate of absorption is:
1.8% after 24 hours
3.2% after one week
9% after one month
14% after six weeks

II—FIRING MEASUREMENTS

Cylindrical blocks of double base propellant of 200 mm height and 90 mm $\phi$ coated with an inhibitor of 5 mm thickness prepared as described hereinabove have been subjected to combustion. Two series of measurements have been carried out:

(1) By means of an experimental device which permits to evaluate the transversal and longitudinal transparency. In this manner, one obtains a calculated appreciation of the discretion.

(2) By considering the condition of the pouch after firing. The weight before and after the firing permits to find out the rate of the ablation (% by weight of the material ejected in the form of gas during the course of firing).

| | Rate of Ablation | Transmission | |
|---|---|---|---|
| | | Transversal | Longitudinal |
| composition 1 | 7% | ≧90% | 50% minimum |
| composition 2 | 9% | ≧90% | 55% minimum |
| composition 3 | 6.6% | ≧90% | 60% minimum |
| composition 4 | 11% | ≧90% | 50% minimum |
| composition 5 | 20% | ≧90% | 40% minimum |

What is claimed is:

1. A gasifiable inhibitor for a double base propellant which comprises a polyurethane elastomer having in chemically combined form a product which is an aliphatic polyester polyol or an aliphatic polyether polyol, or a mixture thereof which product contains 2–6 hydroxyl groups per molecule, an aliphatic polyisocyanate, at least one organic gasifiable charge and an aliphatic plasticizer, and 0.1–10 parts by weight of mineral fibers or thermostable organic fibers of length between 0.1 mm and 15 mm per 100 parts inhibitor.

2. The combustion inhibitor according to claim 1 which additionally contains a low molecular weight polyol as a chain extender.

3. The combustion inhibitor according to claim 1 wherein the inhibitor is applied to a double base propellant comprising nitrocellulose and nitroglycerin.

4. The combustion inhibitor according to claim 1 which comprises 0.5–4 parts by weight of fibers per 100 parts of inhibitor.

5. The combustion inhibitor according to claim 1 wherein the fibers have a length between 0.5 and 6 mm.

6. The combustion inhibitor according to claim 1 wherein in said polyol polyester or polyol polyether, the ratio between the number of carbon atoms and the number of oxygen atoms is less than 5.

7. The combustion inhibitor according to claim 1 wherein said polyol has a molecular weight between 400 and 5,000.

8. The combustion inhibitor according to claim 1 which includes up to 300 parts of a gasifiable charge which is a member selected from the group consisting of oxamide, ammonium oxalate, ammonium carbonate, polyoxyethylene, polyoxypropylene and polyoxymethylene per 100 parts of said polyurethane.

9. The combustion inhibitor according to claim 1 wherein said fibers are glass fibers, carbon fibers, silicone carbide fibers, asbestos fibers or polyphenylene terephthalamide fibers.

* * * * *